US009624616B2

(12) United States Patent
Kim et al.

(10) Patent No.: US 9,624,616 B2
(45) Date of Patent: Apr. 18, 2017

(54) LAUNDRY TREATMENT APPARATUS

(71) Applicant: LG ELECTRONICS INC., Seoul (KR)

(72) Inventors: Keunjoo Kim, Seoul (KR); Jinwoong Kim, Seoul (KR); Seungchul Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 72 days.

(21) Appl. No.: 14/626,296

(22) Filed: Feb. 19, 2015

(65) Prior Publication Data

US 2015/0233036 A1 Aug. 20, 2015

(30) Foreign Application Priority Data

Feb. 20, 2014 (KR) ..... 10-2014-0019614

(51) Int. Cl.
*D06F 37/20* (2006.01)
*D06F 37/26* (2006.01)
(Continued)

(52) U.S. Cl.
CPC ..... *D06F 37/203* (2013.01); *D06F 37/225* (2013.01); *D06F 37/265* (2013.01);
(Continued)

(58) Field of Classification Search
CPC ..... D06F 37/225; D06F 37/203; D06F 33/02; D06F 37/245; D06F 37/06
USPC ... 68/23.2, 12.06, 140, 139, 23.1, 200, 23.5, 68/12.19, 24; 74/572.4, 570.1, 573.11, 74/86, 570.21; 210/144, 363, 380.2
See application file for complete search history.

(56) References Cited

U.S. PATENT DOCUMENTS

2012/0144598 A1* 6/2012 Ostdiek ..... D06F 37/225 8/137
2013/0031939 A1* 2/2013 Hasanreisoglu ..... D06F 37/065 68/139
(Continued)

FOREIGN PATENT DOCUMENTS

EP 1693500 A2 8/2006
TR WO 2011080119 A1 * 7/2011 ..... D06F 37/065
(Continued)

*Primary Examiner* — Michael Barr
*Assistant Examiner* — Thomas Bucci
(74) *Attorney, Agent, or Firm* — Dentons US LLP

(57) ABSTRACT

A laundry treatment apparatus including at least three balancers fixed to a drum such that they are spaced apart from one another at regular angular intervals around a rotational center of the drum, each of the at least three balancers being divided into a front chamber close to the front side of the drum and a rear chamber close to a rear side of the drum for accommodation of liquid and including a guide channel member for guiding liquid to the rear chamber, a channel unit comprising a first channel member for supplying liquid to the front chambers of the balancers and a second channel member for supplying liquid to the guide channel members of the balancers, and a supply unit capable of concurrently supplying liquid to both the first and second channel members or of selectively supplying liquid to one of the first and second channel members is disclosed.

18 Claims, 14 Drawing Sheets

(51) Int. Cl.

| | |
|---|---|
| ***D06F 37/22*** | (2006.01) |
| *D06F 33/02* | (2006.01) |
| *D06F 37/06* | (2006.01) |

(52) U.S. Cl.
CPC ..... *D06F 33/02* (2013.01); *D06F 37/06* (2013.01); *D06F 2222/00* (2013.01)

(56) References Cited

U.S. PATENT DOCUMENTS

| | | | | |
|---|---|---|---|---|
| 2014/0223969 | A1* | 8/2014 | Kim ..... | D06F 37/225 68/12.06 |
| 2015/0075229 | A1* | 3/2015 | Malheiros ..... | D06F 37/225 68/140 |

FOREIGN PATENT DOCUMENTS

| | | | | |
|---|---|---|---|---|
| TR | WO 2011144539 | A1 * | 11/2011 | ..... D06F 37/225 |
| WO | 2011-080119 | A1 | 7/2011 | |

* cited by examiner (a)

(b)

(a)

(b)

(a)

(b)

LAUNDRY TREATMENT APPARATUS

This application claims the benefit of Korean Patent Application No. 10-2014-0019614 filed on Feb. 20, 2014 which is hereby incorporated by reference as if fully set forth herein.

BACKGROUND

Field

The present disclosure relates to a laundry treatment apparatus.

Discussion of the Related Art

A conventional laundry treatment apparatus includes a cabinet forming an appearance of the laundry treatment apparatus, a tub installed in the cabinet, a drum rotatably installed in the tub to wash laundry, and a motor having a rotating shaft coupled to the drum while passing through the tub so as to rotate the drum.

The drum may rotate without the need to maintain a dynamic equilibrium (dynamic balance) depending on a position of laundry disposed therein.

"Dynamic equilibrium" means a state wherein, during rotation of a rotating body, a centrifugal force of the rotating body or a moment created by the centrifugal force becomes zero with respect to the axis of rotation. In the case of a rigid body, dynamic equilibrium is maintained when the mass of the rigid body is evenly distributed about the axis of rotation.

Accordingly, a dynamic equilibrium in a laundry treatment apparatus may be considered as a state where the mass distribution of laundry about an axis of rotation of a drum including laundry contained therein falls within an allowable range during rotation of the drum (a state where the drum rotates within an allowable amplitude range of vibration).

Meanwhile, an unbalanced state, or a state wherein the dynamic equilibrium in a laundry treatment apparatus is lost, means that the mass distribution of laundry about the axis of rotation of a drum is non-uniform during rotation of the drum. Such a loss of dynamic equilibrium occurs when laundry is not evenly distributed along an inner surface of the drum.

When a drum rotates in an unbalanced state, vibration is generated. The vibration of the drum is transmitted to a tub or a cabinet and generates noise.

Conventional laundry treatment apparatuses are typically equipped with a balancer to resolve an unbalanced state of a drum. Balancers incorporated in such conventional laundry treatment apparatuses include ball balancers or fluid balancers in which a ball or fluid is contained in a housing fixed to a drum.

When a drum is in the unbalanced state, the drum exhibits the highest rotational speed when laundry incurring the unbalanced state passes through the lowest point of the rotational orbit of the drum and exhibits the lowest rotational speed when laundry incurring the unbalanced state passes through the highest point of the rotational orbit of the drum.

Therefore, a ball balancer or a fluid balancer incorporated in conventional laundry treatment apparatuses controls an unbalanced state by moving a ball or fluid toward the lowest point of a rotational orbit of a drum when laundry incurring the unbalanced state moves toward the highest point of the rotational orbit of the drum.

Although the above-mentioned method of controlling an unbalanced state in a laundry treatment apparatus is useful when the amplitude of a steady state vibration of a drum falls within a predetermined range, satisfactory effects cannot be obtained under the type of transient vibration to which the drum is subjected to before the vibration of the drum reaches the steady state.

Furthermore, conventional balancers experience difficulty in immediately and actively resolving unbalanced states when such unbalance occurs.

SUMMARY

Accordingly, the present disclosure is directed to a laundry treatment apparatus that substantially obviates one or more problems that remain unresolved by limitations and disadvantages of the related art.

An object of the present disclosure is to provide a laundry treatment apparatus configured to actively resolve an unbalance of a rotating drum containing laundry.

Another object of the present disclosure is to provide a laundry treatment apparatus configured to resolve an unbalance of a rotating drum by supplying liquid to a means for agitating laundry disposed in the drum.

A further object of the present disclosure is to provide a laundry treatment apparatus capable of resolving not only unbalance on a transverse plane of a drum but also unbalance on a longitudinal plane of a drum.

Additional advantages, objectives, and features of the invention will be set forth in part in the description that follows, will become apparent to those having ordinary skill in the art upon examination of the following, or may be learned from practice of the invention. The objectives and advantages of the invention may be realized and attained through the structure particularly pointed out in the written description and claims hereof as well as the appended drawings.

To achieve these objectives and advantages in accordance with the purpose of the invention and as embodied and broadly described herein, a laundry treatment apparatus includes a cabinet including an introduction opening through which laundry is introduced into the apparatus, a drum rotatably disposed in the cabinet and including a drum inlet provided at a front side thereof, the drum inlet communicating with the introduction opening, at least three balancers fixed to the drum such that they are spaced apart from one another at regular angular intervals around a rotational center of the drum, each of the at least three balancers being divided into a front chamber close to the front side of the drum and a rear chamber close to a rear side of the drum for accommodating liquid and including a guide channel member for guiding liquid to the rear chamber, a channel unit comprising a first channel member for supplying liquid to the front chambers of the balancers and a second channel member for supplying liquid to the guide channel members of the balancers, and a supply unit capable of concurrently supplying liquid to both the first and second channel members or selectively supplying liquid to one of the first and second channel members.

Each of the at least three balancers may include a storage body fixed to the drum and having a space for accommodating liquid, a first supply hole provided at the storage body and communicating with the first channel member, and a second supply hole provided at the storage body so as to be positioned farther than the first supply hole from the rotational center of the drum and connecting the second channel member with the guide channel member.

The guide channel member may be bent toward the rotational center of the drum away from the second supply hole and then extends into the rear chamber of the balancer.

The at least three balancers may be disposed so as to extend in a longitudinal direction of the drum and to protrude from an inner surface of the drum toward the rotational center of the drum.

Each of the at least three balancers may further include a partition wall dividing an internal space of the storage body into a front chamber and a rear chamber, a communication opening for communicating of the front chamber with the rear chamber, and a discharge unit for discharging liquid disposed in the front and second chambers outside of the drum.

Each of the at least three balancers may further include a cover forming an upper surface of the storage body, and a pair of fluctuation blocking plates protruding from the cover toward the storage body to minimize fluctuation of a water level in the first and second chambers.

Each of the at least three balancers may further include a cover forming an upper surface of the storage body, wherein the discharge unit may include a discharge guide obliquely extending from the cover toward the rotational center of the drum, and a discharge pipe provided at the discharge guide to extend through the rear side of the drum.

Each of the at least three balancers may further include a supply guide obliquely extending from the cover toward the rotational center of the drum to guide liquid supplied from the first channel member into the front chamber.

The drum may be inclined by a predetermined angle with respect to a bottom surface of the cabinet, wherein an inclined angle of the drum with respect to the bottom surface of the cabinet may be equal to an inclined angle of the supply guide with respect to the cover.

The channel unit may further include a base body provided along an outer circumferential surface of the drum inlet and fixed to the front side of the drum, and a base flange extending from the base body toward the introduction opening, wherein the first channel member may include a first channel body extending from the base body toward the introduction opening, and a first flange extending inwardly and then toward the base flange from the first channel body, and wherein the second channel member may include a second channel body extending from the base body toward the introduction opening, and a second flange extending inwardly and then toward the first channel body from the second channel body.

The channel unit may further include a first channel partition wall provided at the first channel body to divide the first channel member into first channel spaces corresponding in number to the number of the balancers and to guide liquid introduced into one of the first channel spaces into a corresponding one of the balancers, and a second channel partition wall provided at the second channel body to divide the second channel member into second channel spaces corresponding in number to the number of the balancers and to guide liquid introduced into one of the second channel spaces into a corresponding one of the balancers.

The laundry treatment apparatus may further include a first guide provided between the base flange and the first channel body above the first channel partition wall to guide liquid supplied from the supply unit into the first channel member, and a second guide provided between the first channel body and the second channel body above the second channel partition wall to guide liquid supplied from the supply unit into the second channel member.

Each of the at least three balancers may include a storage body fixed to the drum and forming a space for accommodating liquid, a first supply hole provided at the storage body and communicating with the first channel member, and a second supply hole provided at the storage body so as to be positioned farther than the first supply hole from the rotational center of the drum and connecting the second channel member with the guide channel member, wherein the first guide may have a width equal to or greater than that of the first supply hole, and wherein the second guide may have a width equal to or greater than that of the second supply hole.

The channel unit may further include a first channel leakage prevention portion extending from the first flange toward the base body, a second flow path leakage prevention portion extending from the second flange toward the base body, and an extension protruding from the first flange toward the introduction opening to prevent liquid discharged from the first flow path from being introduced into the second flow path.

The channel unit may further include a plurality of first ribs protruding from the base body, and a plurality of second ribs protruding from the first flow path body.

The supply unit may include first and second introduction parts to which liquid from a water supply source is supplied, a first discharge part for discharging liquid supplied to the first introduction part to the first flow path, and a second discharge part for discharging liquid supplied to the second introduction part to the second flow path, wherein the first introduction part may have a cross-sectional shape different from that of the first discharge part, and the second introduction part has a cross-sectional shape different from that of the second discharge part.

The first discharge part may have a cross-section of a long slit shape parallel to a circumferential direction of the first flow path, and the second discharge part may have a cross-section of a long slit shape parallel to a circumferential direction of the second flow path.

The supply unit may include a first supply pipe connecting the first introduction part with the water supply source, a first valve for opening and closing the first supply pipe, a second supply pipe connecting the second introduction part with the water supply source, and a second valve for opening and closing the second supply pipe.

The laundry treatment apparatus may further include a sensing unit for detecting a position of laundry causing unbalance of the drum, and a control unit for controlling the first and second valves to supply liquid to at least one of the first and second flow paths during a period of time from a point where the drum is rotated by a predetermined standby angle to a point where the drum is rotated by a predetermined supply angle after laundry reaches a position of the supply unit.

The at least three balancers may be spaced apart from one another along a circumferential surface of the drum by an angular interval of 120°, the predetermined standby angle may be set to 60° and the predetermined supply angle may be set to 120°.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the invention and are incorporated in and constitute a part of this application, illustrate embodiment(s) of the disclosure and together with the description serve to explain the principle of the disclosure. In the drawings.

DETAILED DESCRIPTION

Reference will now be made in detail to the preferred embodiments of the present invention, examples of which are illustrated in the accompanying drawings. It should be noted herein that construction of an apparatus, which will hereinafter be described, and a method of controlling the apparatus are given only for illustrative purposes and the protection scope of the invention is not limited thereto. Wherever possible, the same reference numbers will be used throughout the drawings to refer to the same or like parts.

Figure 1:
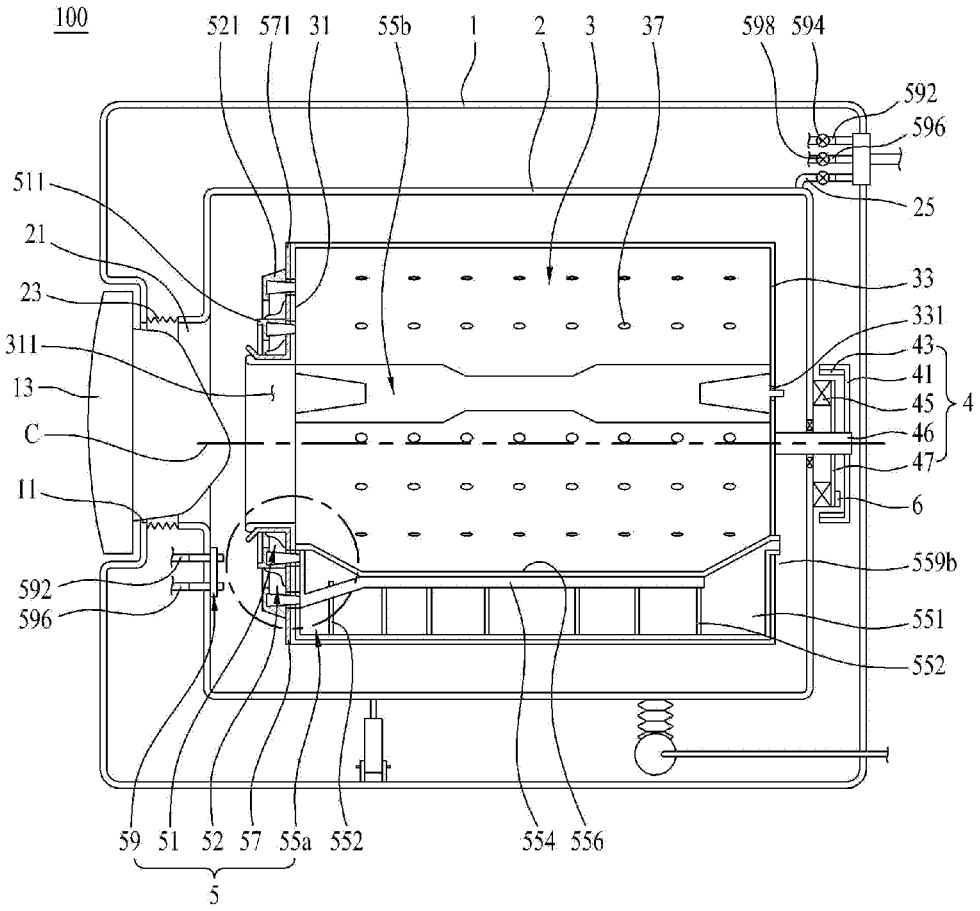
FIG. 1(*a*) is a cross-sectional view showing a laundry treatment apparatus according to the present disclosure and FIG. 1(*b*) is a close-up view of the balancing unit according to the present disclosure.
Figure 1:
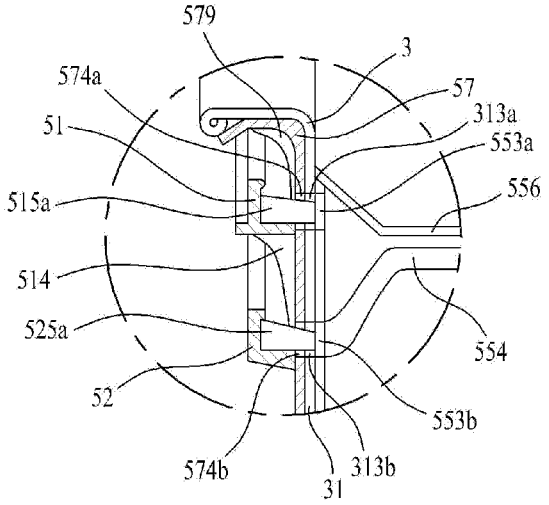

FIG. 1 illustrates a laundry treatment apparatus according to the present invention. As shown in FIG. 1, the laundry treatment apparatus 100 according to the present invention may include a cabinet 1 forming an appearance of the apparatus 100, a tub 2 provided in the cabinet 1 to contain washing water, a drum 3 rotatably provided in the tub 2 to receive laundry, a drive unit 4 for rotating the drum 3, and a balancing unit 5 for controlling unbalance caused by laundry by transiently increasing weight of a region of the drum 3 positioned opposite to the laundry causing the unbalance.

The laundry treatment apparatus as shown in FIG. 1 is constructed to perform only washing of laundry. Accordingly, a laundry treatment apparatus capable of performing both washing and drying of laundry may have to further include an air supply (not shown) provided in the cabinet 1 to supply air to the drum 3.

Meanwhile, in a laundry treatment apparatus constructed to perform only drying of laundry, although the tub 2 as shown in FIG. 1 may be eliminated from the laundry treatment apparatus, an air supply (not shown) for supplying air to the drum 3 may have to be included in the apparatus.

For convenience of explanation, the present invention will now be described in connection with the laundry treatment apparatus 100 constructed to perform only washing of laundry, as shown in FIG. 1.

The cabinet 1 includes an introduction opening 11 for allowing introduction and retrieval of laundry, and a door 13 hinged to the cabinet 1 to open and close the introduction opening 11.

The tub 2 may have a hollow cylindrical shape, and includes a tub inlet 21 communicating with the introduction opening 11.

Disposed between the introduction opening 11 and the tub inlet 21 may be a gasket 23. The gasket 23 functions to prevent the washing water in the tub 2 from leaking out of the tub 2 and to prevent transmission of vibration of the tub 2 to the cabinet 1.

The drum 3 may comprise a hollow cylindrical drum body disposed in the tub 2.

The drum 3 includes a drum inlet 311 provided at a front side (front side of the drum body) 31 and communicating with the introduction opening 11 and the tub inlet 21. Furthermore, the drum 3 includes a plurality of drum through-holes 37 formed through a circumferential wall of the drum 3 to connect the inside of the drum 3 with the inside of the tub 2.

Accordingly, laundry may be put into or taken out of the drum 3 through the introduction opening 11. Through the drum through-holes 37, washing water in the tub 2 may be transferred to laundry disposed in the drum 3, and washing water contained in laundry may be discharged into the tub 2.

The drive unit 4 may be constructed into any of various configurations so long as the drive unit 4 is capable of rotating the drum 3 in the tub 2. FIG. 1 illustrates a directly coupled motor as an example of the drive unit 4, a rotating shaft of which is extended through a rear side of the tub 2 and is directly coupled to the drum 3 to rotate the drum 3.

As illustrated in FIG. 1, the drive unit 4 may include a stator 45 fixed to the rear side of the tub 2, a rotating shaft 46 which is extended through the rear side of the tub 2 and is fixed to the rear side 33 of the drum 3, a rotor 41 disposed to surround the stator 45 and to which the rotating shaft 46 is fixed, and a plurality of permanent magnets 43 fixed to the rotor 41 to rotate the rotor 41 using a magnetic field generated by the stator 45.

The plurality of permanent magnets 43 are disposed at regular intervals and are fixed to an inner surface of the rotor 41. The stator 45 is insulated by means of an insulator 47 surrounding the stator 45.

The insulator 47 may include a sensing unit (such as a Hall sensor) 6 for sensing magnetic force of the permanent magnets 43 to detect a rotating speed, a rotating direction and a rotating angle of the rotor 41. The sensing unit will be described later.

The balancing unit 5 functions to attenuate unbalance of the drum 3 by transiently increasing the weight of a region of the drum 3 symmetrically opposite to a region of the drum 3 at which the laundry causing unbalance is positioned with respect to the center of rotation of the drum 3.

Figure 2:
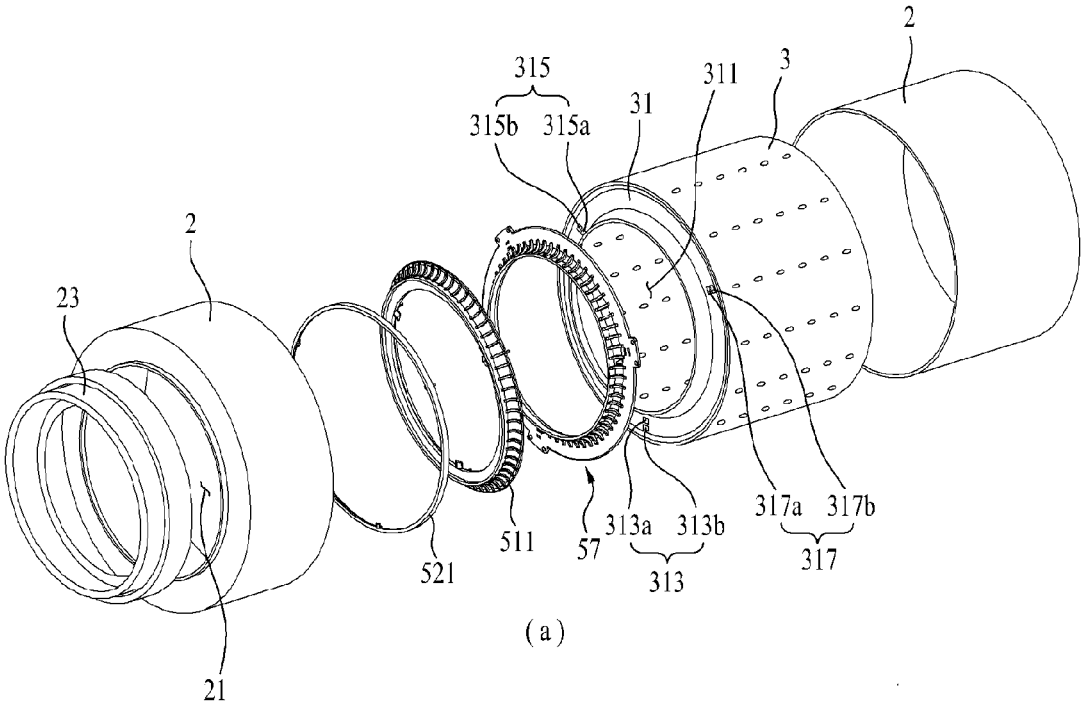
FIG. 2 is a view showing a structure in which a balancing unit is coupled to a drum according to the present disclosure.
Figure 2:
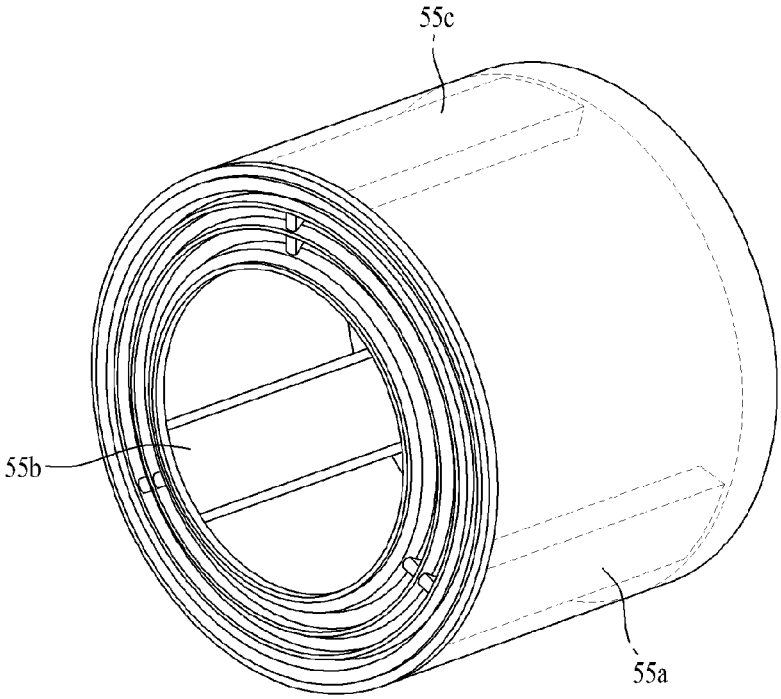

As illustrated in FIG. 2, the balancing unit 5 may include at least three balancers 55 spaced apart from one another by regular intervals and fixed to the drum 3, a supply unit 59 provided at the tub 2 or the gasket 23 to supply liquid toward the front side 31 of the drum 3, and a channel unit (51, 52, 57) provided at the front side 31 or the rear side 33 of the drum 3 (the rear side of the drum body) to direct the liquid supplied from the supply unit 59 toward the respective balancers 55.

The balancers 55 may be provided in any of various numbers so long as the balancers 55 are spaced apart from one another by regular angular intervals. For convenience of explanation, an embodiment in which first balancer 55*a*, second balancer 55*b*, and third balancer 55*c* are provided will now be described.

Although the balancers 55 may be provided on an outer surface of the drum 3, the balancers 55 are provided on an inner surface of the drum 3 in such a manner as to protrude toward the center C of the drum 3, as illustrated in FIG. 2.

The balancers 55 protruding from the inner surface of the drum 3 according to the present invention may serve not only as a means for resolving unbalance but also as a means for agitating laundry disposed in the drum during rotation of the drum 3.

When the three balancers 55*a*, 55*b*, 55*c* are provided at the inner surface of the drum 3, the front side 31 of the drum 3 is provided with a first balancer supply hole 313 communicating with the first balancer 55*a*, a second balancer supply hole 315 communicating with the second balancer 55*b* and a third balancer supply hole 317 communicating with the third balancer 55*c*.

The first balancer supply hole 313 includes a front supply hole 313*a* and a rear supply hole 313*b*, and the second balancer supply hole 315 and the third balancer supply hole 317 also include front supply holes 315*a* and 317*a* and rear supply holes 315*b* and 317*b*, respectively.

Figure 3:
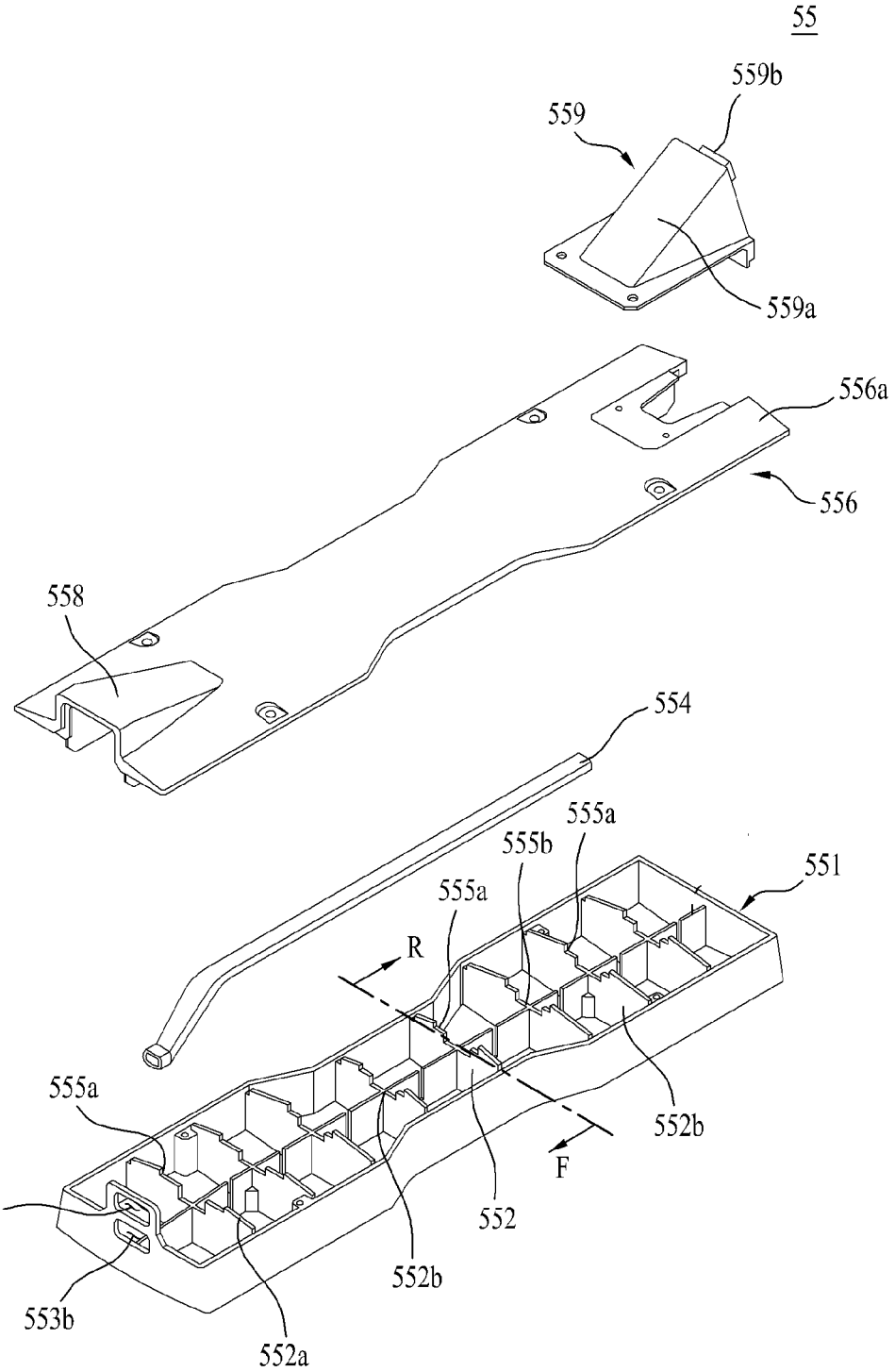
FIGS. 3 to 6 are views showing a balancer according the present disclosure.

As illustrated in FIG. 3, each of the balancers 55 includes a storage body 551 fixed to the inner surface of the drum 3 to provide a space for storing liquid, a cover 556 constituting an upper wall of the storage body 551, and a discharge unit 559 provided at the cover 556 to discharge the liquid stored in the storage body 551 to the outside.

The storage body 551 is divided, by a partition wall 552, into a front chamber F extending from the front side 31 of the drum 3 toward the rear side 33 of the drum 3 and a rear chamber R extending from the rear side 33 of the drum 3 toward the front side 31 of the drum 3.

The division of the inner space of the storage body 551 into the front chamber F and the rear chamber R serves to resolve not only unbalance on a plane of the drum 3 parallel to a diametrical direction of the drum 3 but also unbalance on a plane parallel to a longitudinal direction of the drum 3 (where laundry is concentrated at one of the front and rear sides of the drum 3), which will be described in detail later.

Since the front chamber F and the rear chamber R communicate with each other through a communication opening 555*a* formed at the partition wall 552, liquid contained in the front chamber F may be transferred to the discharge unit 559 through the rear chamber R when the position of the corresponding balancer 55 is changed due to rotation of the drum 3.

Each of the front chamber F and the rear chamber R may be further divided into a plurality of sub-chambers by means of sub-partition walls 552*a* and 552*b*.

The further division of each of the front chamber F and the rear chamber R by means of the sub-partition walls 552*a* and 552*b* is to rapidly resolve unbalance when laundry is concentrated at one of the front and rear sides of the drum 3, by allowing successive sub-chambers of the front chamber F or the rear chamber R to be sequentially filled with liquid in such a manner that one of the successive sub-chambers is filled with liquid after another one of the successive sub-chambers is filled with liquid. The plurality of sub-chambers are connected to one another through communication openings 555*a* formed at the sub-partition walls 552*a* and 552*b*.

One of the storage body 511 and the cover 556 is provided with a first supply hole 553*a* and a second supply hole 553*b* both of which communicate with the front chamber F. The second supply hole 553*b* is connected to a guide flow path 554 for guiding liquid into the rear chamber R.

In this case, the first supply hole 553*a* formed at the first balancer 55*a* communicates with the front supply hole 313*a* of the first balancer supply hole 313 and the second supply hole 553*b* communicates with the rear supply hole 313*b*.

Furthermore, the first supply hole and the second supply hole formed at the second balancer 55*b* communicate with the front supply hole 315*a* and the rear supply hole 315*b* of the second balancer supply hole 315, respectively, and the first supply hole and the second supply hole formed at the third balancer 55*c* communicate with the front supply hole 317*a* and the rear supply hole 317*b* of the third balancer supply hole 317, respectively.

The guide flow path 554 may comprise a pipe which is bent toward the cover 556 (that is, toward the center of rotation of the drum 3) from the second supply hole 553*b* and then is extended to the rear chamber R.

In this case, a distance from the center of rotation of the drum 3 to the first supply hole 553*a* is preferably smaller than the distance from the center of rotation of the drum 3 to the second supply hole 553*b*. In other words, the first supply hole 553*a* is preferably positioned above the second supply hole 553*b* in a direction of the height of the drum 3 with respect to the bottom surface of the storage body 551. This serves to increase a storage capacity of the storage body 551, and a detailed description thereof will be given later.

The guide flow path 554 is held in the storage body 551 by means of the holding openings 555*b* formed at the partition wall 552. The guide flow path 554 may have a length such that liquid is first supplied to the sub-chambers closest to the rear side 33 of the drum 3 (the sub-chambers positioned farthest from the front side of the drum 3) among the plurality of sub-chambers provided in the rear chamber R.

The communication openings 555*a* may be disposed at the same position as the holding openings 555*b*, or at a higher position than the holding openings 555*b*.

The cover 556 may include a cover body 556*a* constituting an upper surface of the storage body 551, and a supply guide 558 protruding from the upper surface of the cover body 556*a* to guide liquid introduced into the first supply hole 553*a* toward the front chamber F.

Figure 4:
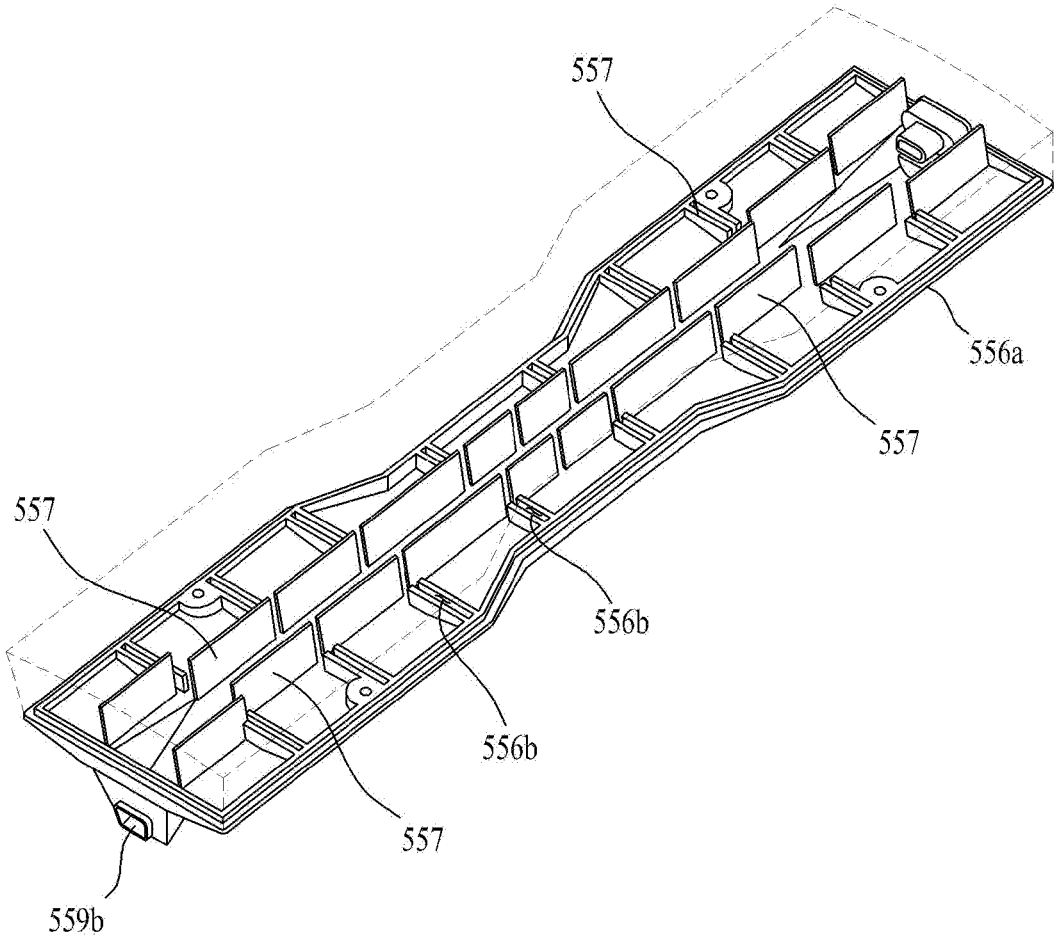

As illustrated in FIG. 4, the cover body 556*a* may be provided at a lower surface thereof with partition reception grooves 556*b* so as to allow the partition wall 552 and the sub-partition walls 552*a* and 552*b* provided at the storage body 551 to be fitted therein.

However, the partition reception grooves 556*b* have to be provided in such a manner as to avoid interfering with the communication openings 555*a* formed at the storage body 551. As a result, the sub-chambers defined by the partition walls 552, 552*a* and 552*b* may communicate with one another through the communication openings 555*a*.

Figure 5:
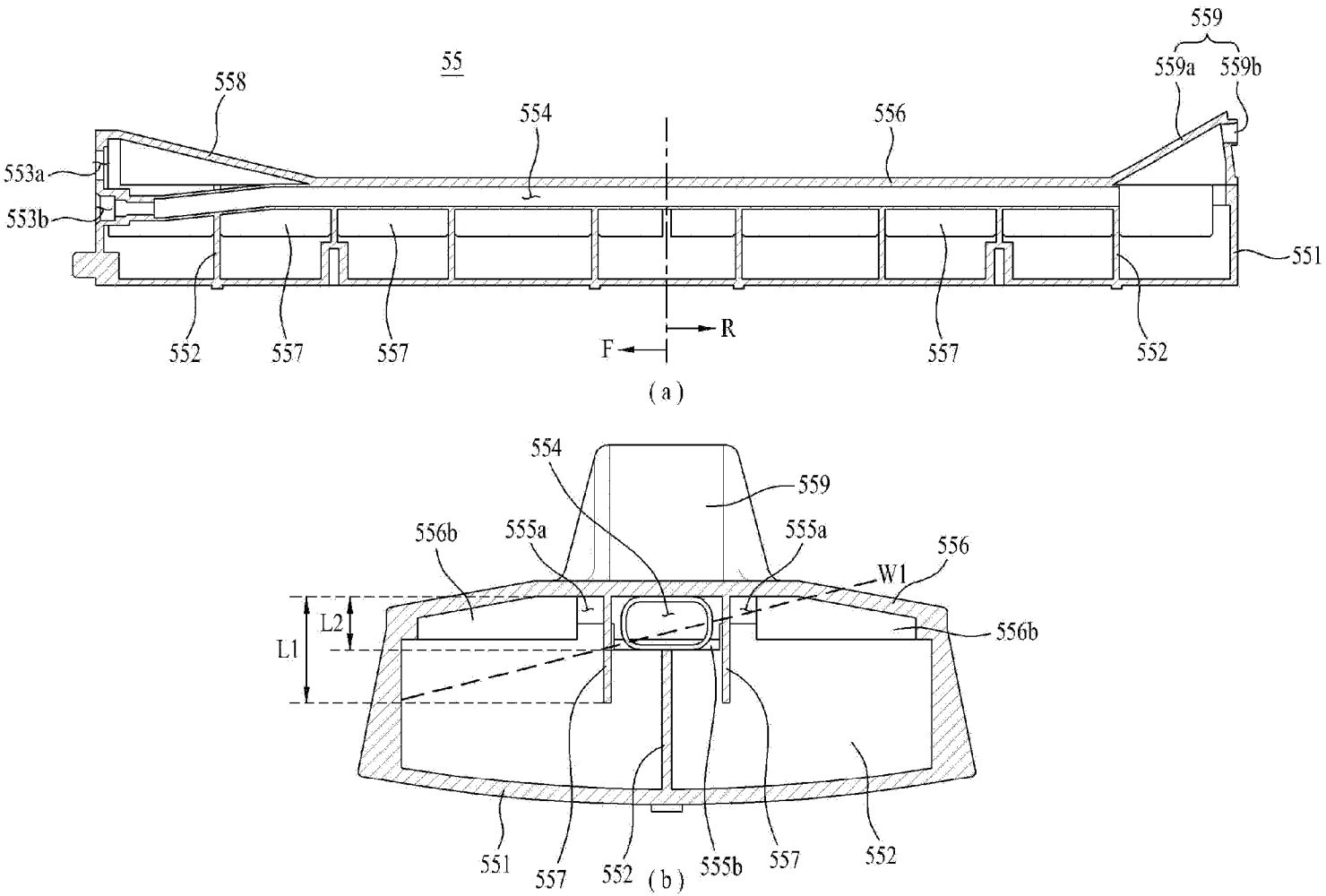

As illustrated in FIG. 5, the cover body 556*a* (see FIG. 3) may be further provided at a lower surface thereof (a surface facing the storage body 551) with fluctuation blocking plates 557 which protrude toward the bottom surface of the storage body 551 but do not come into contact with the storage body 551.

The fluctuation blocking plates 557 preferably comprise a pair of plates which are spaced apart from each other by a width equal to or greater than that of holding openings 555*b* in which the guide flow path 554 is held. The distance from the cover body 556*a* to the free ends of the fluctuation blocking plates 557 is preferably larger than that the distance from the cover body 556*a* to the holding openings 555*b*.

The fluctuation blocking plates 557 function to prevent liquid contained in one sub-chamber from flowing into another adjacent sub-chamber through the corresponding holding opening 555*b* rather than through the corresponding communication opening 555*a* when a level of water contained in the storage body 551 fluctuates due to acceleration of the drum 3.

It may be possible to effectively resolve unbalance incurred by concentration of laundry at the front side or rear side of the drum 3 when liquid supplied through the first supply hole 553*a* or the guide flow path 554 has to be charged into one of the sub-chambers defined by the sub-partition walls 552*a* and 552*b* after the former sub-chamber is completely filled. Through the fluctuation blocking plates 557, a fluctuation in water level in the storage body 551 caused by acceleration of the drum 3 is minimized, and liquid contained in one sub-chamber may be transferred to an adjacent sub-chamber only through the corresponding communication openings 555*a*.

The cover body 556*a* is provided at an upper surface thereof with the discharge unit 559 for discharging liquid contained in the storage body 551 outside of the drum 3. The discharge unit 559 may include a discharge guide 559*a* protruding from the cover body 556*a*, and a discharge pipe 559*b* provided at the discharge guide 559*a*.

The discharge pipe 559*b* extends through the rear side 33 of the drum 3 to connect the inside of the storage body 551 with the outside of the drum 3. The discharge guide 559*a* may be obliquely constructed to guide liquid in the storage body 551 toward the discharge pipe 559*b*.

Each of the balancers 55, which has the configuration as described above, has advantageous effects of maximizing storage capacity of the balancers 55 by means of a positional relation of the first supply hole 553*a* and the second supply hole 553*b* and the presence of the guide flow path 554.

More specifically, since the first supply hole 553*a* is positioned above the second supply hole 553*b* and the guide flow path 554 extends from the second supply hole 553*b* toward the rear chamber R, the highest water level in the front chamber F becomes a level of the first supply hole 553*a* or the communication openings 555*a*, and the highest water level of the rear chamber R becomes a level of the holding openings 555*b*.

Furthermore, since the guide flow path 554 comprises a pipe which is bent toward the rotational center C of the drum 3 from the second supply hole 553*b* and is then extended toward the rear chamber R, a level of the holding opening 555*b* is increased and thus the maximum water level of the rear chamber R is correspondingly increased.

Each balancer 55 is constructed such that liquid is supplied into the storage body 551 when the drum 3 passes through the lowest point of its rotational orbit, and the liquid contained in the storage body 551 is discharged outside of the drum 3 when the drum 3 passes through the highest point of its rotational orbit.

Figure 6:
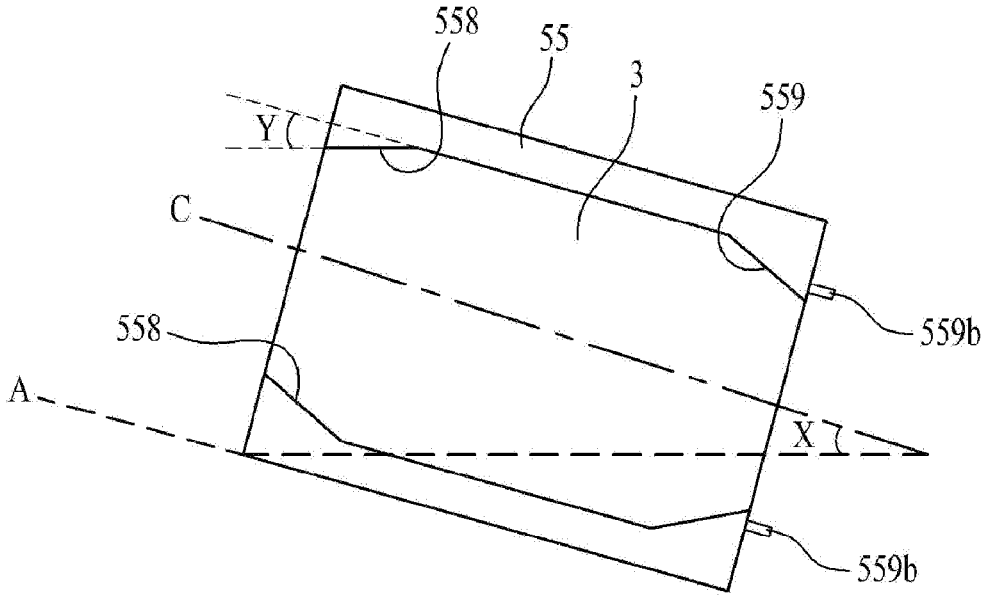

As illustrated in FIG. 6, liquid which has been introduced into the storage body 551 through the channel unit (51, 52, 57) while the drum 3 rotates toward the lowest point A of the rotational orbit of the drum 3 is discharged outside of the drum 3 through the discharge pipe 559*b* while the drum rotates toward the highest point of the rotational orbit.

In this case, since the cover body 556*a* is provided with the discharge guide 559*a* inclined toward the discharge pipe 559*b*, the liquid contained in the storage body 551 may be quickly discharged.

Furthermore, when the drum 3 is obliquely installed at a predetermined angle with respect to a basal plane at which the cabinet 1 is supported, the liquid contained in the storage body 551 may be more quickly discharged.

However, if the drum 3 is inclined at a greater angle than the predetermined angle with respect to the bottom surface of the cabinet 1, there is a possibility that the liquid contained in the storage body 551 is discharged through the supply guide 558 and then is supplied to laundry contained in the drum 3. In order to minimize the above problems, an inclined angle Y of the supply guide 558 is preferably set to be equal to or smaller than an inclined angle of the drum 3 to the bottom surface of the cabinet 1.

The balancer 55, which is constructed as described above, is supplied with liquid through the channel unit (51, 52, 57) provided at at least one of the front side 31 and the rear side 33 of the drum 3.

FIG. 2 illustrates an embodiment in which the channel unit is provided at the front side 31 of the drum 3. In this case, the channel unit may include a base 57 provided at the front side of the drum 3, a first channel member 51 provided at the base 57 to guide liquid toward the front supply holes 313*a*, 315*a* and 317*a*, and a second channel member 52 provided at the base 57 to guide liquid toward the rear supply holes 313*b*, 315*b* and 317*b*.

Since the role of the base 57 may also be fulfilled by the front side 31 and the drum inlet 311 of the drum 3, the base 57 may, of course, be omitted. The present invention will now be described with reference to an embodiment including the base 57.

Figure 7:
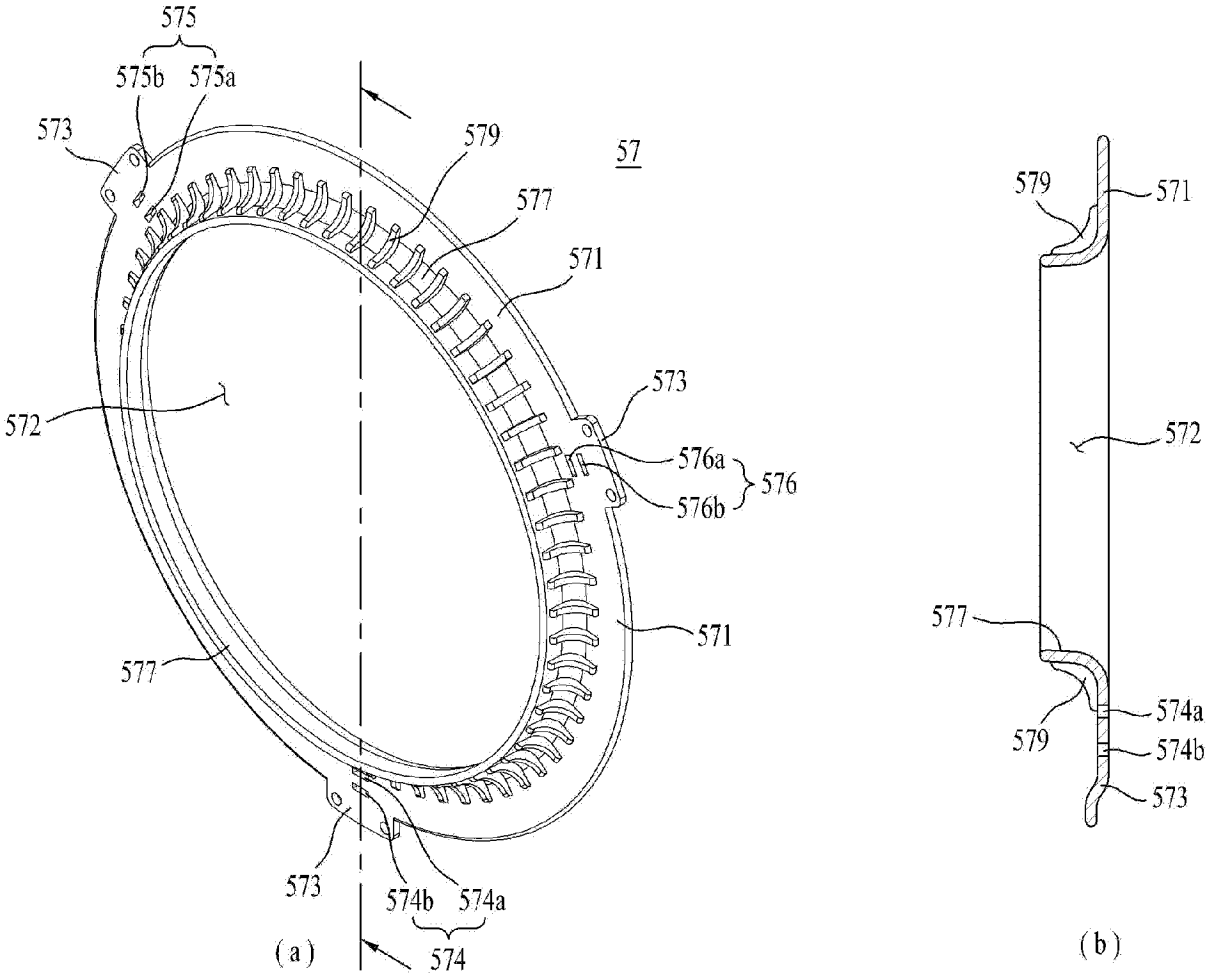
FIGS. 7 to 9 are views showing a channel unit according to the present disclosure.

As illustrated in FIG. 7, the base 57 includes a base body 571 coupled to the front side of the drum 3, and a base flange 577 extending from the base body 571 toward the introduction opening 11.

The base body 571 may comprise an annular plate having a center hole 572. The base flange 577 may extend from a peripheral edge of the center hole 572 toward the introduction opening 11.

When the drum inlet 311 extends from the front side 31 of the drum 3 toward the introduction opening 11, the base flange 577 may have to accommodate an outer surface of the drum inlet 311.

The base body 571 includes a first communication hole 574 communicating with the first balancer supply hole 313, a second communication hole 575 communicating with the second balancer supply hole 315, and a third communication hole 576 communicating with the third balancer supply hole 317.

The first communication hole 574 may include a front communication hole 574*a* and a rear communication hole formed at the base body 57, which communicate with the front supply hole 313*a* and the rear supply hole 313*b* of the first balancer supply hole 313, respectively.

The second and third communication holes 575 and 576 are also formed at the base body 571. The second communication hole 575 may include a front communication hole 575*a* and a rear communication hole 575*b* which communicate with the front supply hole 315*a* and the rear supply hole 315*b* of the second balancer supply hole 315, respectively, and the third communication hole 576 may include a front communication hole 576*a* and a rear communication hole 576*b* which communicate with the front supply hole 317*a* and the rear supply hole 317*b* of the third balancer supply hole 317, respectively.

The base body 571 may be coupled to the front side of the drum 3 by coupling sections 573 provided at a peripheral edge thereof. Provided at both the base body 571 and the base flange 577 may be a plurality of first ribs 579 protruding in a direction away from the center of rotation of the drum 3.

The first ribs 579 function not only to guide liquid supplied from a supply unit 59 (which will be described later) toward the first channel member 51 but also to temporarily prevent liquid supplied to the base 57 rotating with the drum 3 from moving in the first channel member 51.

Figure 8:
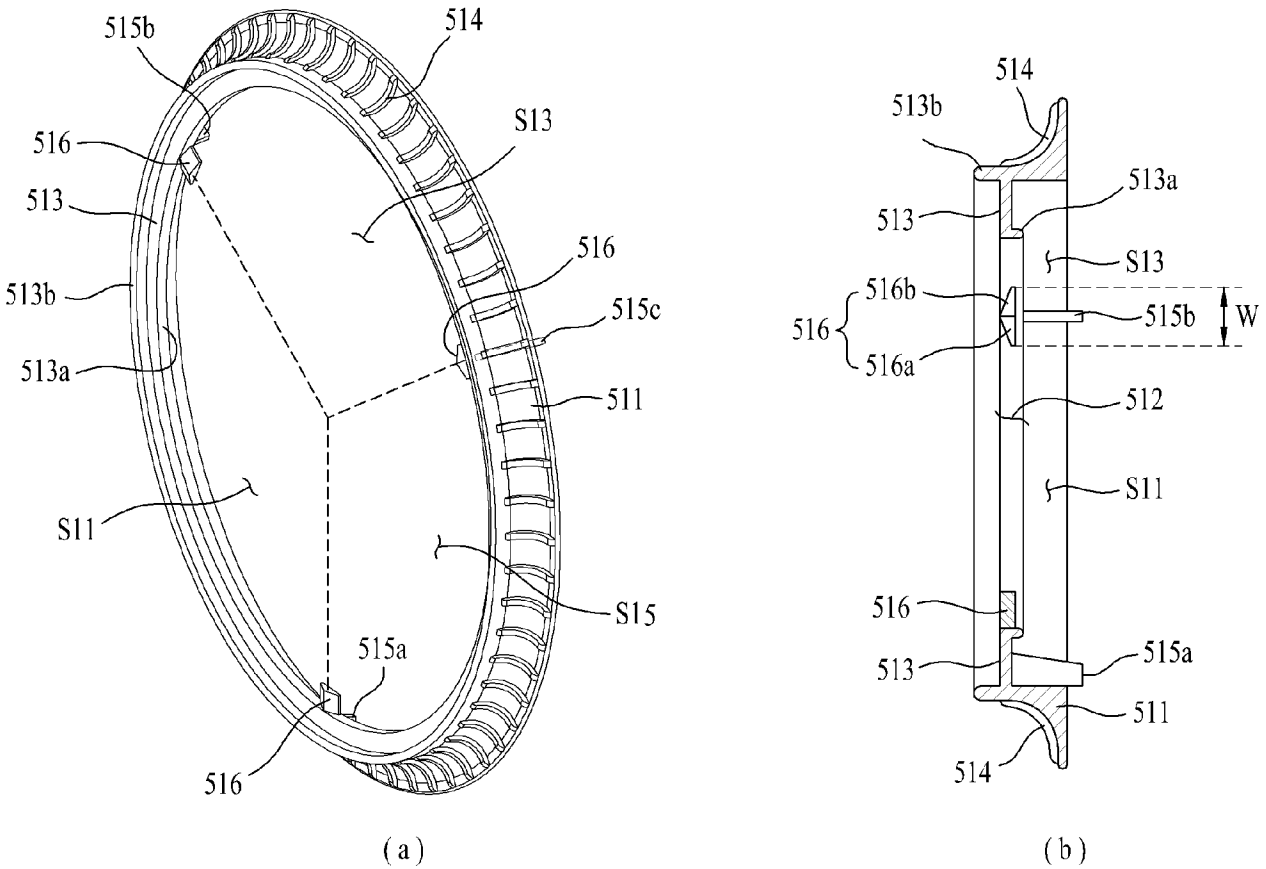
Figure 9:
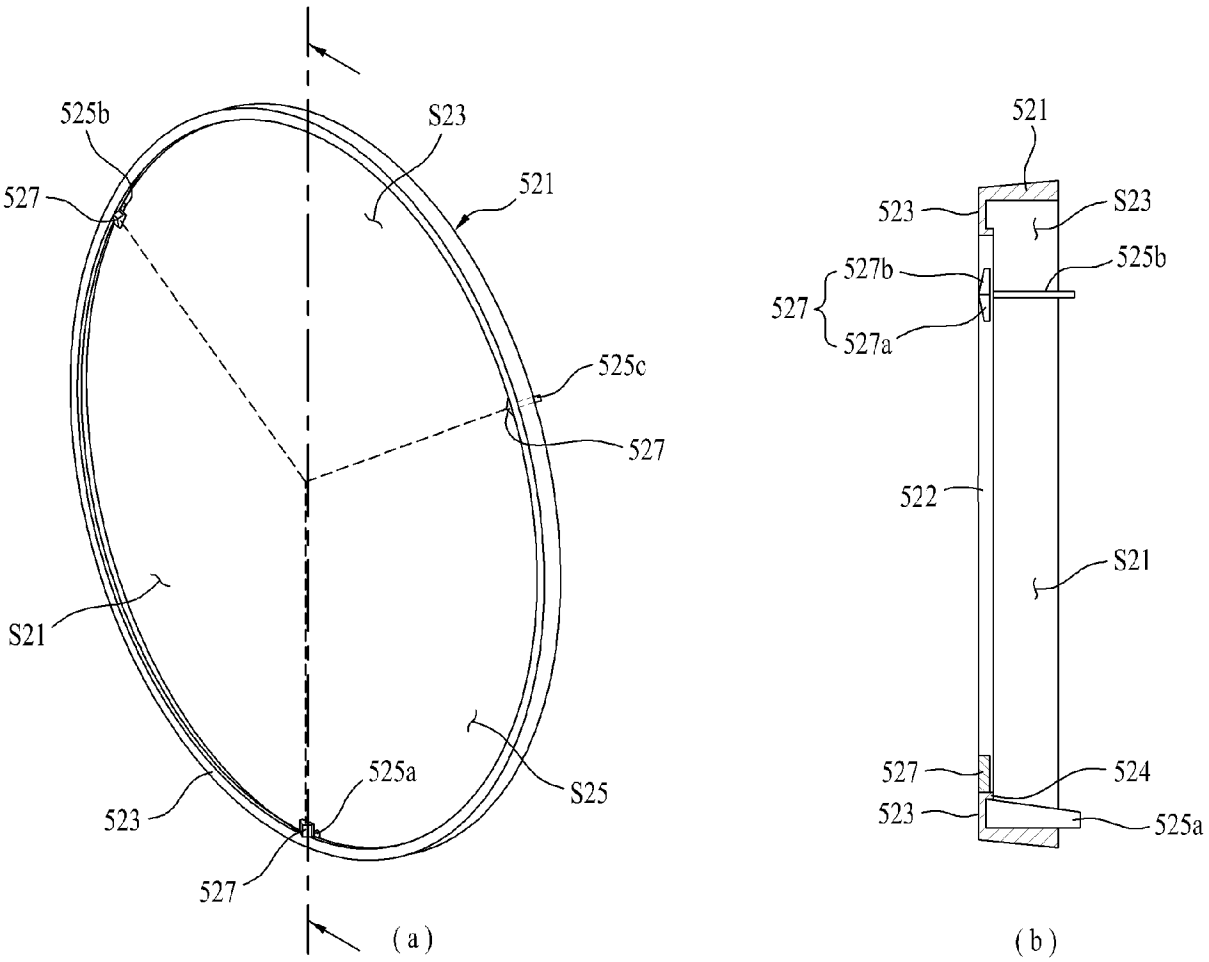

The first channel member 51 according to the present invention may include an annular first channel body 511 having a first body center hole 512, and a first flange 513 extending from the first channel body 511 toward the base flange 577 (see FIG. 8).

The first channel body 511 is fixed to the base body 571 in such a manner as to be spaced apart from the base flange 577 by a predetermined distance. The first flange 513 protrudes toward the base flange 577.

A plurality of second ribs 514 are provided at a surface of the first channel body 511 facing a second channel body 521 which will be described later. The second ribs 514 function not only to guide liquid supplied from the supply unit toward the second channel member 52 but also to temporarily prevent liquid supplied to the first channel body 51 rotating with the drum 3 from moving in the second channel member 52.

Since the first flange 513 has a greater inner diameter than that of the base flange 577, an outer surface of the base flange 577 is maintained spaced apart from the first flange 513 by a predetermined distance.

The first flange 513 may further include a leakage prevention portion 513*a* for preventing liquid introduced into the first channel member 51 from leaking out. The leakage prevention portion 513*a* may extend from the first flange 513 toward the base body 571.

The first flange 513 may further include an extension 513*b* extending from the first flange 513 toward the introduction opening 11. The extension 513*b* functions to prevent liquid leaking from the first channel member 51 from entering the second channel member 52 despite presence of the first flange 513.

The above described effects of the extension 513*b* may be obtained not only when the drum 3 is inclined with respect to the bottom surface of the cabinet 1 by a predetermined angle but also when the drum 3 is disposed parallel to the bottom surface of the cabinet 1.

The internal space defined by the base body 571, the base flange 577, the first channel body 511 and the first flange 513 is divided into the same number of spaces as the number of the balancers 55 by first channel partition walls provided at the first channel body 511.

As described above, when the three balancers 55*a*, 55*b* and 55*c*, which are spaced apart from one another by an angle of 120° with respect to the center of rotation of the drum 3, are provided in the drum 3, the first channel member 51 may be provided with three first channel partition walls 515*a*, 515*b* and 515*c* which divide the internal space of the first channel member 51 into a first space S11, a second space S13 and a third space S15.

Each of the first channel partition walls 515*a*, 515*b* and 515*c* protrudes from the first channel body 511 and extends from the first flange 513 toward the base body 571. The first channel partition walls 515*a*, 515*b* and 515*c* are fitted in the front communication holes 574*a*, 575*a* and 576*a* formed at the base body 571, respectively.

The first channel body 511 may further include first guides 516 which are provided in a space between the first flange 513 and the base flange 577 above the first channel partition walls 515*a*, 515*b* and 515*c*.

The first guides 516, which function to guide liquid supplied from the supply unit 59 into the first channel member 51, may include a first inclined surface 516*a* and a second inclined surface 516*b*.

Liquid supplied to the first channel member 51 from the supply unit 59 may leak from the inside to the outside of the first channel member 51 due to a supply pressure of the liquid. Provision of the first guides 516 may minimize the above leakage problem.

When each of the first guides 516 has a larger width (W) than that of each of the front communication holes 574*a*, 575*a* and 576*a*, liquid may be supplied to only a desired one of the spaces S11, S13 and S15 provided in the first channel member 51, and a detailed description thereof will be given later.

The second channel member 52 according to the present invention is defined by the second channel body 521 provided at the base body 571 and spaced apart from the first channel body 511 and a second flange 523.

The second channel body 521 includes a second body center hole 522. The second flange 523 extends from an inner surface of the second body center hole 522 toward the first channel body 511.

The second flange 523 is provided with a leakage prevention portion 524 extending from an inner edge of the second flange 523 toward the base body 571. The leakage prevention portion 524 prevents liquid introduced into the second channel member 52 from leaking to the outside of the second channel member 53.

The second channel body 521 is provided with three second channel partition walls 525*a*, 525*b* and 525*c* for dividing the internal space of the second channel member 52 into a fourth space S21, a fifth space S23 and a sixth space S25.

The second channel partition walls 525*a*, 525*b* and 525*c* extend from the second flange 523 toward the base body 571. The second channel partition walls 525*a*, 525*b* and 525*c* are fitted in the respective rear communication holes 574*b*, 575*b* and 576*b* formed at the base body 571.

The second channel body 521 may further include second guides 527 which are provided in a space between the second flange 523 and the first channel body 511 above the second channel partition walls 525*a*, 525*b* and 525*c*.

The second guides 527, which function to guide liquid supplied from the supply unit 59 into the second channel member 52, may include a first inclined surface 527*a* and a second inclined surface 527*b*. Other functions of the second guides 527 are identical to those of the first guides 516, and thus a detailed description thereof is omitted.

Figure 10:
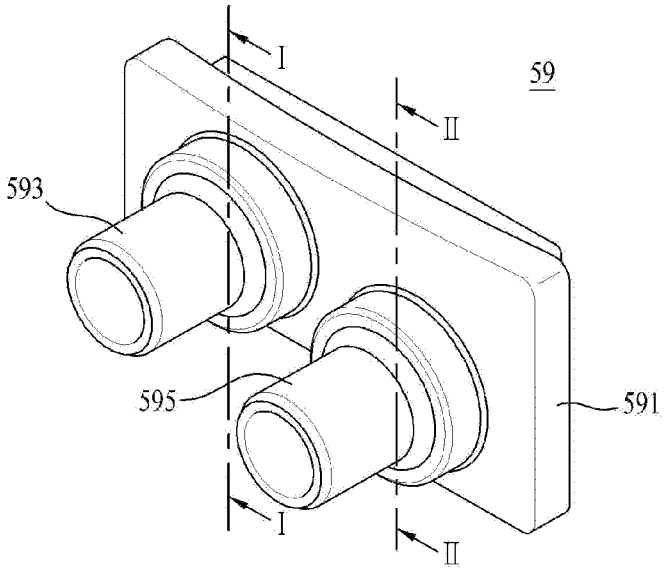
FIGS. 10 and 11 are views showing a supply unit according to the present disclosure.
Figure 10:
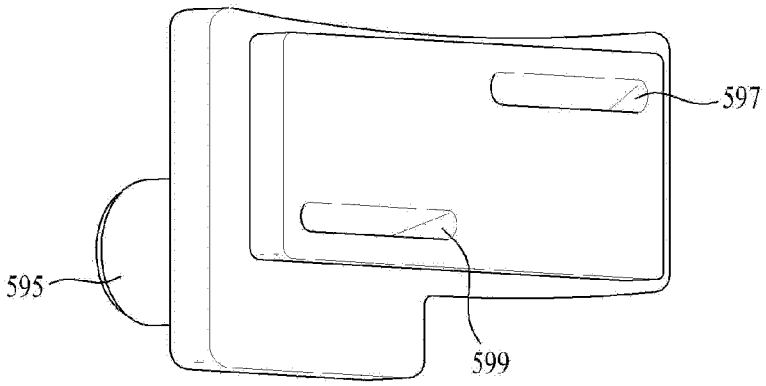

FIG. 10 illustrates the supply unit 59 provided at the balancing unit 5 according to the present disclosure. The supply unit 59 may be provided at any positions of the laundry treatment apparatus so long as the supply unit may supply liquid to both the first channel member 51 and the second channel member 52. However, when the laundry treatment includes the tub 2 for washing laundry, the supply unit 59 may be provided at the tub 2 or the gasket 23.

The supply unit 59 may include a body 591 fixed to the tub 2 or the gasket 23, first and second introduction parts 593 and 595 which are provided at the body 591 and to which liquid from an outer water supply source is supplied, a first discharge part 597 communicating with the first introduction part 593 to discharge liquid to the first channel member 51, and a second discharge part 599 communicating with the second introduction part 595 to discharge liquid to the second channel member 52.

When liquid supplied to the first and second channel members 51 and 52 is water, the first and second introduction parts 593 and 595 may communicate with first and second supply pipes 592 and 596, respectively, which are connected to a water supply source (not shown) provided at the outside of the cabinet 1 (see FIG. 1).

Meanwhile, in order to control supply of liquid to one or both of the first and second introduction parts 593 and 595, the first and second supply pipes 592 and 596 may be provided with first and second valves 594 and 598, respectively.

The first and second supply pipes 592 and 596 may be branched from a tub supply pipe 25 for supplying water to the tub 2.

Figure 11:
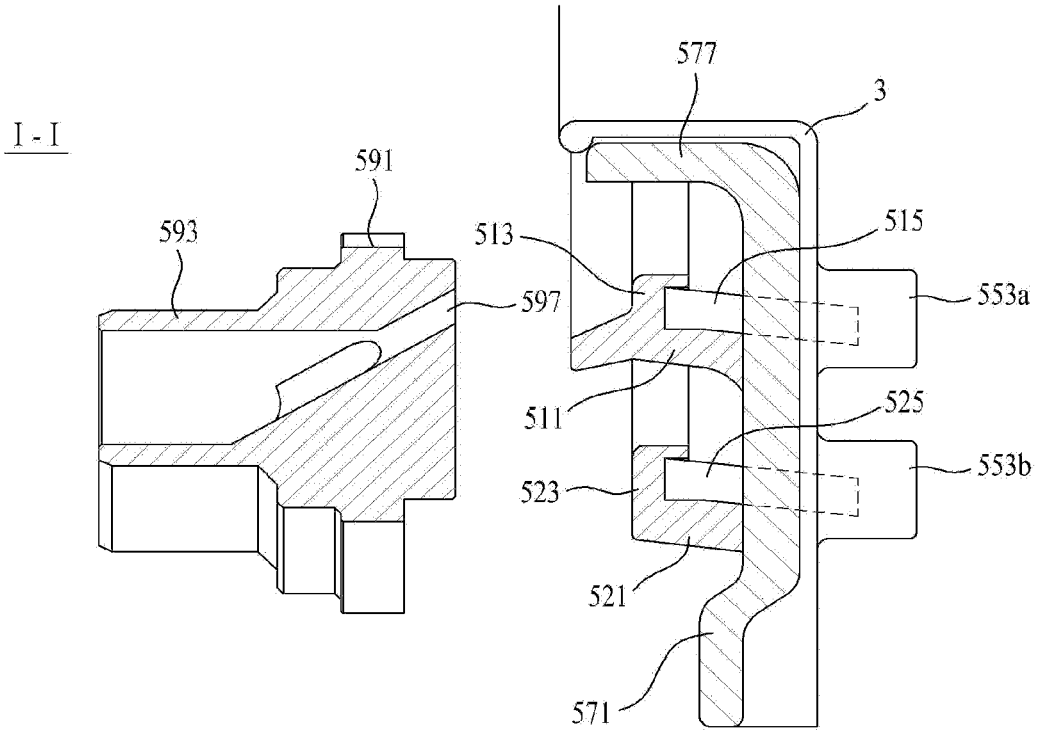
Figure 11:
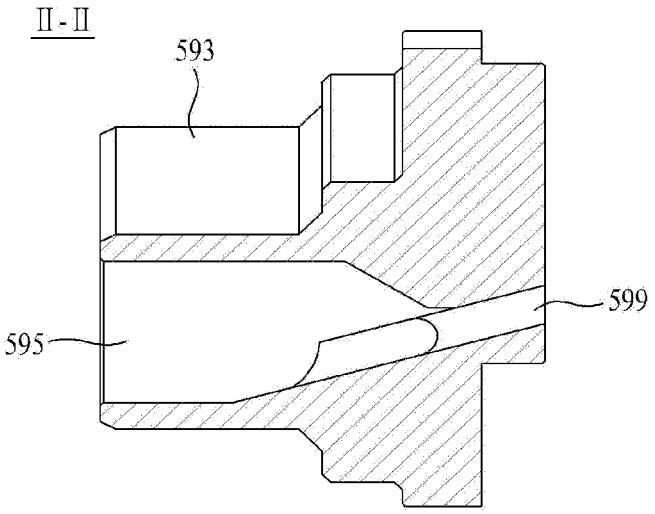

As illustrated in FIG. 11, the first introduction part 593 may have a cross-sectional shape different from that of the first discharge part 597, and the second introduction part 595 may have a cross-sectional shape different from that of the second discharge part 599.

More specifically, the first and second introduction parts 593 and 595 may have a circular cross-section whereas the first and second discharge parts 597 and 599 may have a slit-shaped cross-section. In this case, the first discharge part 597 preferably comprises a long slit parallel to a circumferential direction of the first channel member 51 and the second discharge part 599 also comprises a long slit parallel to a circumferential direction of the second channel member 52.

This serves to prevent the risk that liquid supplied from the first and second discharge parts 597 and 599 is not introduced into the first and second channel members 51 and 52 when the drum 3 droops toward the bottom surface of the cabinet 1 due to the weight of the laundry.

In other words, the first discharge part 597 is constructed to supply liquid to a space between the base flange 577 and the first flange 513, and the second discharge part 599 is constructed to supply liquid to a space between the first channel body 511 and the second flange 523. The drum 3 may droop due to the weight of the laundry. Accordingly, when each of the first and second discharge parts 597 and 599 has a cross-section comprising a slit having a width larger than a height, it is possible to minimize the risk that liquid supplied from the first and second discharge parts 597 and 599 is not introduced into the first and second channel members 51 and 52 even if the position of the drum 3 varies due to the weight of the laundry.

Furthermore, the first introduction part 593 and the first discharge part 597 may have the same cross-sectional area, and the second introduction part 595 and the second discharge part 599 may also have the same cross-sectional area. This serves to minimize the possibility that a flow rate of liquid supplied through the first and second discharge parts 597 and 599 becomes less than that of liquid supplied through the first and second introduction parts 593 and 595 even though the introduction parts and the discharge parts have different cross-sectional areas.

The supply unit 59 having the above-described structure is preferably disposed at a position corresponding to the sensing unit 6.

For example, the sensing unit 6 is positioned to detect the magnetic force of the permanent magnets of the rotor 41 passing through the lowest point of the rotational orbit of the drum 3, and the supply unit 59 is positioned to supply liquid toward the lowest point of the rotational orbit of the drum 3.

Figure 12:
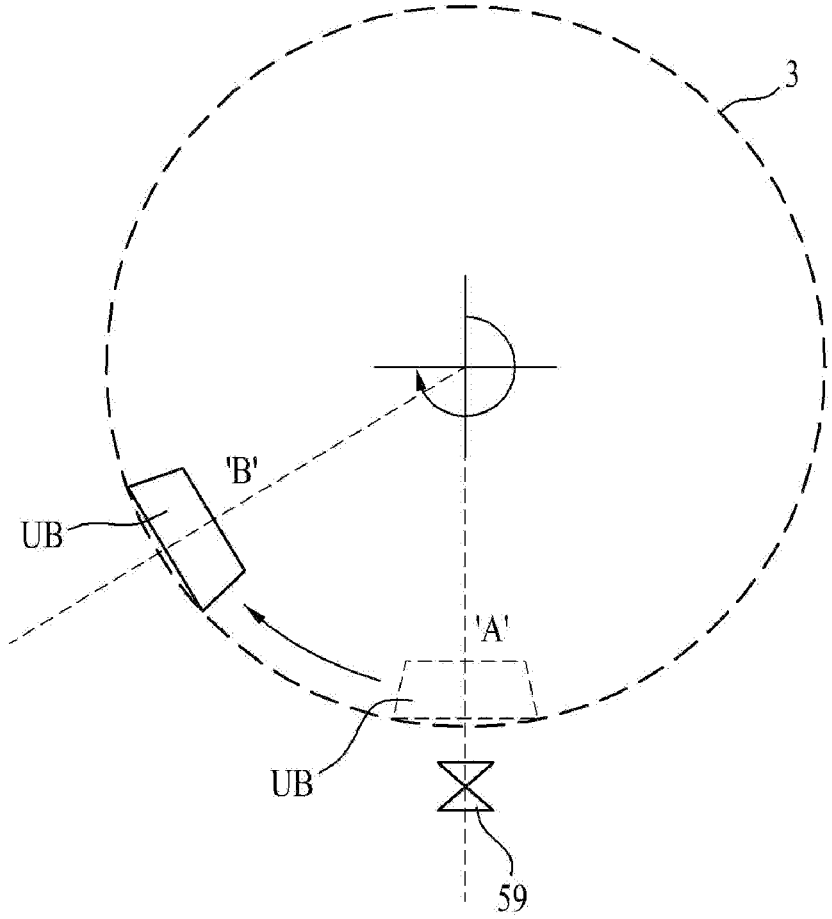
FIGS. 12 to 14 are views showing a procedure of attenuating unbalance according to the present disclosure.

As illustrated in FIG. 12, a control unit (not shown) according to the present invention operates to attenuate unbalance in such a way that, when laundry UB causing unbalance rotates from a point A of the supply unit 59 to a point B that is angularly spaced from the point A by a predetermined angle, the supply unit 59 supplies liquid to one of balancers 55*a*, 55*b* and 55*c* for a predetermined period of time (required for the drum 3 to rotate by the predetermined angle).

Accordingly, in the case where the sensing unit 6 and the supply unit 59 are positioned at the same plane passing through the rotation axis C of the drum 3, when the sensing unit 6 transmits a signal indicating that the laundry passes through the lowest point of the rotational orbit of the drum 3, the control unit may determine that laundry causing unbalance passes through the supply unit 59, thus facilitating control of unbalance.

Hereinafter, a process of controlling unbalance will be described with reference to FIGS. 13 and 14.

A case where laundry causing unbalance is uniformly distributed along a longitudinal direction of the drum 3 (where the difference between the weight of a front side and the weight of a rear side of the drum 3 falls within a predetermined range) will first be described.

The control unit (not shown) determines a region of the drum 3 at which laundry UB causing unbalance is positioned by measuring the rotational speed of the drum on the basis of data provided from the sensing unit 6 during rotation of the drum 3.

Thereafter, the control unit determines whether the laundry UB causing unbalance passes through the lowest point of the rotational orbit of the drum at which the supply unit 59 is positioned. When it is determined that the laundry UB causing unbalance passes through the supply unit 59, the control unit determines whether the drum 3 is rotated by a predetermined standby angle (D).

When the drum 3 is rotated by the standby angle (D), the control unit operates to open the valves 594 and 598 and thus to allow liquid to be supplied to the first channel member 51 and the second channel member 52 until the drum 3 is rotated by a predetermined supply angle (S).

In the case where the balancers 55 are provided at a circumferential surface of the drum 3 such that they are spaced apart from one another by an angle of 120°, the standby angle (D) may be set to 60° and the supply angle (S) may be set to 120°.

In the case where the balancers 55 are provided at the circumferential surface of the drum 3 such that they are spaced apart from one another by an angle of 90°, both the standby angle (D) and the supply angle (S) may be set to an angle of 90°. Meanwhile, in the case where the balancers 55 are provided at the circumferential surface of the drum 3 such that they are spaced apart from one another by an angle of 60°, the standby angle (D) and the supply angle (S) may be set to 120° and 60°, respectively.

However, the angles may be adjusted by controlling an amount of liquid discharged from the first discharge part 597 and the second discharge part 599.

Figure 13:
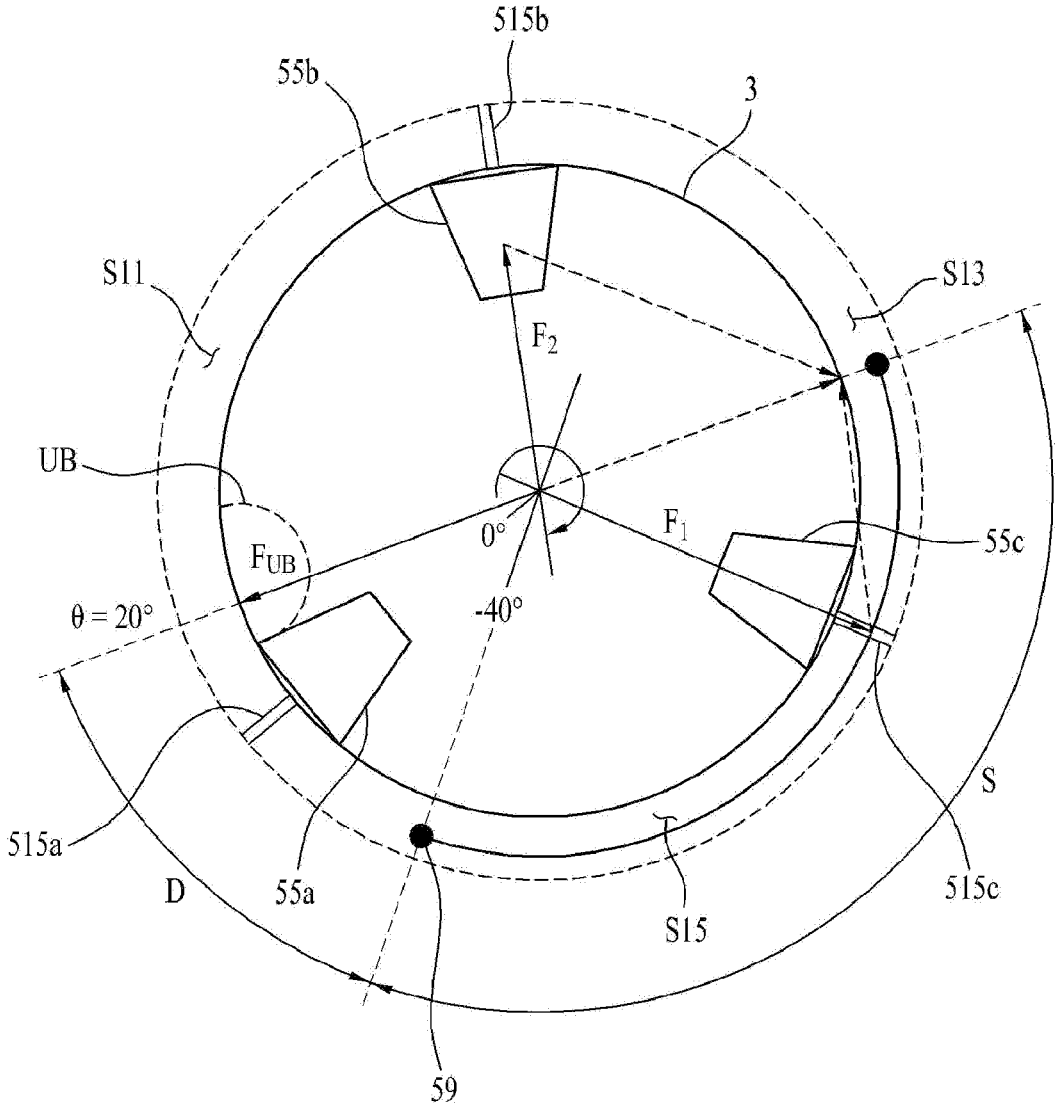

When laundry is concentrated between the first balancer 55*a* and the second balancer 55*b* as illustrated in FIG. 13, liquid has to be supplied to the second balancer 55*b* and the third balancer 55*c* in order to attenuate the force (Fub) causing unbalance.

Accordingly, the control unit controls the first and second valves 594 and 598 to supply liquid from the first and second discharge parts 597 and 599 until the drum 3 is rotated from the point where the drum 3 is rotated by the standby angle of 60° after the laundry UB passes through the supply unit 59 to the point where the drum 3 is rotated by the supply angle of 120°.

In this case, liquid discharged from the first discharge part 597 will be supplied to the third and second spaces S15 and S13 provided in the first channel member 51, and, although not shown, liquid discharged from the second discharge part 599 will be supplied to the sixth and fifth spaces S25 and S23 provided in the second channel member 52.

Figure 14:
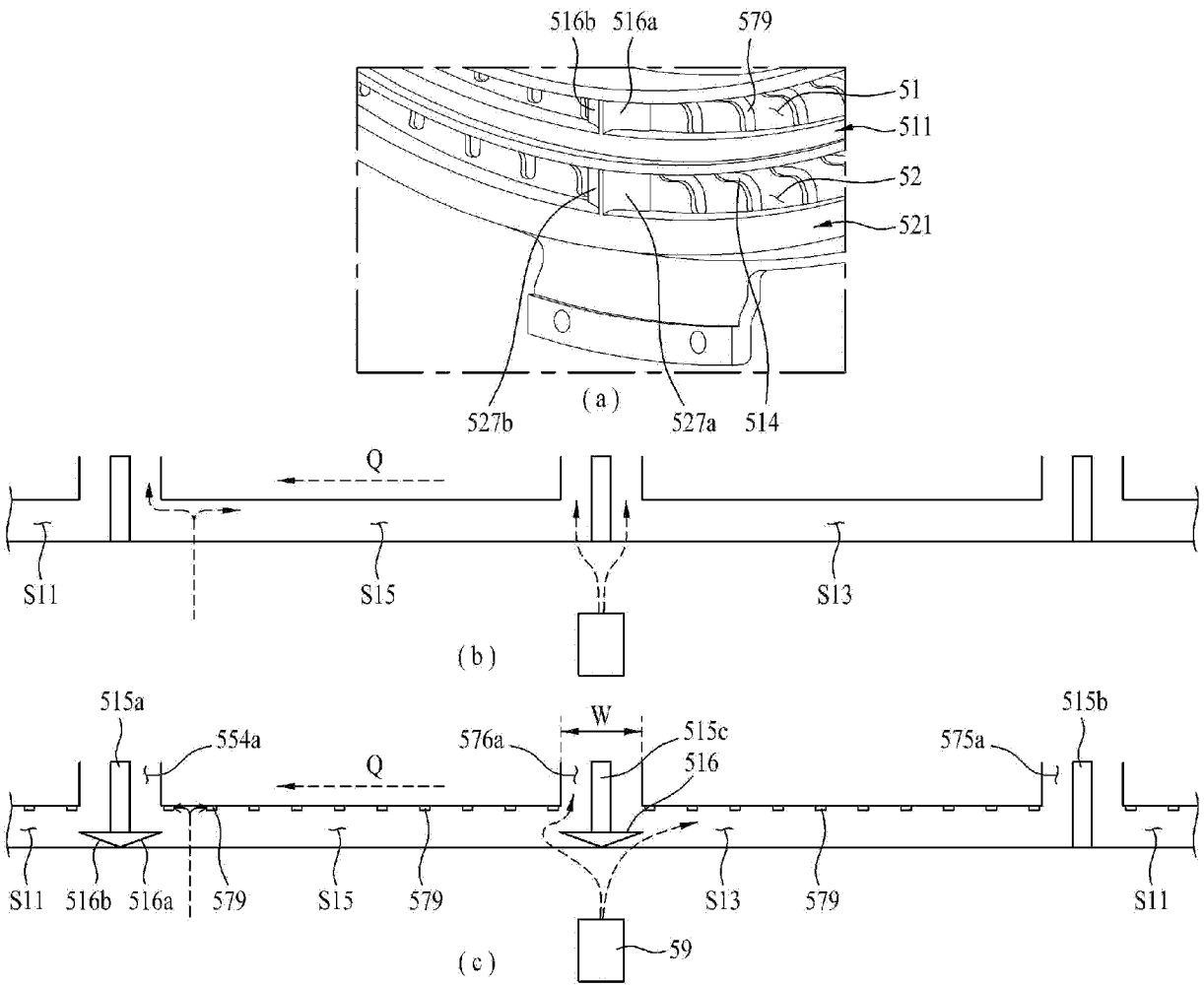

As illustrated in FIG. 14, the liquid supplied to the third space S15 of the first channel member 51 flows in the first channel member 51 in the direction opposite to a direction of rotation (S) of the drum 3 and then is introduced into the front chamber F (See FIG. 3) of the third balancer 55*c* by means of the first channel partition wall 515*c*. Meanwhile, the liquid supplied to the second space S13 of the first channel member 51 is introduced into the front chamber F of the second balancer 55*b* by means of the first channel partition wall 515*b*.

Although not shown in the drawings, the liquid supplied to the third and second spaces are also introduced into the rear chamber R of the third balancer 55*c* and the rear chamber R of the second balancer 55*b*, respectively, by the above principle.

Since the third balancer 55*c* receives liquid supplied from the supply unit 59 during rotation of the drum 3 by an angle of 80° and the second balancer 55*b* receives liquid supplied from the supply unit 59 during rotation of the drum 3 by an angle of 40°, the sum of the force (F1) caused by the liquid contained in the third balancer 55*c* and the force (F2, F2<F1) caused by the liquid contained in the second balancer 55*b* will offset the force (Fub) caused by the laundry.

Accordingly, the present disclosure provides a laundry treatment apparatus which may actively resolve an unbalance of the drum 3 by supplying liquid to the means for agitating laundry disposed in the drum 3.

Since liquid supplied to the first channel member 51 from the supply unit 59 is transiently disposed in spaces defined between the first ribs 579 (FIG. 14(*c*)), it is possible to resolve the problem that liquid flows in a direction Q of rotation of the drum 3 and then enters an unwanted balancer (FIG. 14(*b*)).

Furthermore, since the first guides 516 are provided above the first channel partition walls 515*a*, 515*b* and 515*c*, it is also possible to resolve the problem of liquid supplied from the supply unit 59 undesirably entering a balancer 55 when the first channel partition walls 515*a*, 515*b* and 515*c* pass through the supply unit 59.

The above effect may be obtained when a width W of the first guide 516 is larger than that of the front communication holes 574*a*, 575*a* and 576*a* of that of the first supply hole 553*a* provided in the balancer 55.

Accordingly, when the first inclined surface 516*a* and the second inclined surface 516*b* of each of the first guides 516 are symmetrically constructed with respect to the first channel partition walls 515*a*, 515*b* and 515*c*, the first channel partition walls 515*a*, 515*b* and 515*c* have to be positioned at the centers of the respective front communication holes 574*a*, 575*a* and 576*a* and the centers of the respective first supply holes 553*a*.

Functions of the second ribs 514 and the second guides 527 provided at the second channel member are identical to those of the above-described first ribs 579 and the first guides 516, and thus a detailed description thereof is omitted.

Liquid supplied to the third balancer 55*c* and the second balancer 55*b* may be maintained in the state of being contained in the balancers (due to centrifugal force caused by rotation of the drum 3) during rotation of the drum 3 at a constant rotational speed.

Meanwhile, when the rotational speed of the drum 3 is decreased in order to complete the operation in progress, liquid is discharged outside of the drum 3 through the discharge unit 559 during movement of the balancer toward the highest point of the rotational orbit of the drum 3.

When laundry is concentrated at only one of the front and rear sides 31 and 33 of the drum 3, unbalance caused by the concentration of the laundry may be attenuated in the following way.

When laundry is concentrated at the front side 31 of the drum 3, the control unit supplies liquid only to the rear chambers R of the balancers through the second channel member 52 to attenuate unbalance caused by the concentration of laundry. In this case, a procedure of determining an objective one of the balancers to which liquid is to be supplied is identical to the above-described procedure, and thus a detailed description thereof is omitted.

When laundry is concentrated at the rear side of the drum 3, the control unit supplies liquid to only the front chambers F of the balancers through first channel member 51 to attenuate unbalance of the drum 3.

As described above, the present invention provides a laundry treatment apparatus configured to actively resolve unbalanced rotation (unbalance) of a drum in which laundry is disposed.

Furthermore, the present disclosure provides a laundry treatment apparatus configured to resolve unbalance of a drum by supplying liquid to means for agitating laundry disposed in the drum.

In addition, the present disclosure provides a laundry treatment apparatus capable of resolving not only unbalance on a transverse plane of a drum but also unbalance on a longitudinal plane of a drum.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treatment apparatus comprising:

a cabinet including an introduction opening through which laundry is introduced into the apparatus;

a drum rotatably disposed in the cabinet and including a drum inlet provided at a front side thereof, the drum inlet communicating with the introduction opening;

at least three balancers fixed to the drum such that they are spaced apart from one another by regular angular intervals around a rotational center of the drum, each of the at least three balancers being divided into a front chamber close to the front side of the drum and a rear chamber close to a rear side of the drum for accommodation of liquid and including a guide channel member for guiding liquid to the rear chamber, the guide channel member having a pipe-shape;

a channel unit comprising a first channel member for supplying liquid to the front chambers of the balancers and a second channel member for supplying liquid to the guide channel members of the balancers; and a supply unit capable of concurrently supplying liquid to both the first and second channel members or selectively supplying liquid to one of the first and second channel members, wherein each of the at least three balancers comprises:

a storage body fixed to the drum and having a space for accommodating liquid;

a first supply hole provided at a front side of the storage body and communicating with the first channel member; and a second supply hole provided at the front side of the storage body so as to be positioned farther than the first supply hole from the rotational center of the drum and connecting the second channel member with the guide channel member, and wherein the guide channel member is bent toward the rotational center of the drum away from the second supply hole and then extends into the rear chamber of the balancer.

2. The laundry treatment apparatus according to claim 1, wherein the at least three balancers are disposed so as to extend in a longitudinal direction of the drum and to protrude from an inner surface of the drum toward the rotational center of the drum.

3. The laundry treatment apparatus according to claim 2, wherein each of the at least three balancers further comprises:

a cover forming an upper surface of the storage body;

a partition wall dividing an internal space of the storage body into a front chamber and a rear chamber;

a communication opening for communicating of the front chamber with the rear chamber; and a discharge unit for discharging liquid disposed in the front and rear chambers outside of the drum.

4. The laundry treatment apparatus according to claim 3, wherein each of the at least three balancers further comprises:

a pair of fluctuation blocking plates protruding from the cover toward the storage body to minimize fluctuation of a water level in the front and rear chambers.

5. The laundry treatment apparatus according to claim 3, wherein the discharge unit comprises:

a discharge guide obliquely extending from the cover toward the rotational center of the drum; and a discharge pipe provided at the discharge guide to extend through the rear side of the drum.

6. The laundry treatment apparatus according to claim 3, wherein each of the at least three balancers further comprises a supply guide obliquely extending from the cover toward the rotational center of the drum to guide liquid supplied from the first channel member into the front chamber.

7. The laundry treatment apparatus according to claim 6, wherein the drum is inclined by a predetermined angle with respect to a bottom surface of the cabinet, wherein an inclined angle of the drum with respect to the bottom surface of the cabinet is equal to an inclined angle of the supply guide with respect to the cover.

8. The laundry treatment apparatus according to claim 1, wherein the channel unit further comprises:

a base body provided along an outer circumferential surface of the drum inlet and fixed to the front side of the drum; and a base flange extending from the base body toward the introduction opening, wherein the first channel member comprises:

a first channel body extending from the base body toward the introduction opening; and a first flange extending inwardly and then toward the base flange from the first channel body, and wherein the second channel member comprises:

a second channel body extending from the base body toward the introduction opening; and a second flange extending inwardly and then toward the first channel body from the second channel body.

9. The laundry treatment apparatus according to claim 8, wherein the channel unit further comprises:

a first channel partition wall provided at the first channel body to divide the first channel member into first channel spaces corresponding in number to the number of the balancers and to guide liquid introduced into one of the first channel spaces into a corresponding one of the balancers; and a second channel partition wall provided at the second channel body to divide the second channel member into second channel spaces corresponding in number to the number of the balancers and to guide liquid introduced into one of the second channel spaces into a corresponding one of the balancers.

10. The laundry treatment apparatus according to claim 9, further comprising:

a first guide provided between the base flange and the first channel body above the first channel partition wall to guide liquid supplied from the supply unit into the first channel member; and a second guide provided between the first channel body and the second channel body above the second channel partition wall to guide liquid supplied from the supply unit into the second channel member.

11. The laundry treatment apparatus according to claim 10, wherein each of the at least three balancers comprises:

a storage body fixed to the drum and forming a space for accommodating liquid;

a first supply hole provided at the storage body and communicating with the first channel member; and a second supply hole provided at the storage body so as to be positioned farther than the first supply hole from the rotational center of the drum and connecting the second channel member with the guide channel member, wherein the first guide has a width equal to or greater than that of the first supply hole, and wherein the second guide has a width equal to or greater than that of the second supply hole.

12. The laundry treatment apparatus according to claim 9, wherein the channel unit further comprises:

a first channel leakage prevention portion extending from the first flange toward the base body;

a second channel leakage prevention portion extending from the second flange toward the base body; and an extension protruding from the first flange toward the introduction opening to prevent liquid discharged from the first channel member from being introduced into the second channel member.

13. The laundry treatment apparatus according to claim 9, wherein the channel unit further comprises:

a plurality of first ribs protruding from the base body; and a plurality of second ribs protruding from the first channel body.

14. The laundry treatment apparatus according to claim 1, wherein the supply unit comprises:

first and second introduction parts to which liquid from a water supply source is supplied;

a first discharge part for discharging liquid supplied to the first introduction part to the first channel member; and a second discharge part for discharging liquid supplied to the second introduction part to the second channel member, wherein the first introduction part has a cross-sectional shape different from that of the first discharge part, and the second introduction part has a cross-sectional shape different from that of the second discharge part.

15. The laundry treatment apparatus according to claim 14, wherein the first discharge part has a cross-section comprising a long slit shape parallel to a circumferential direction of the first channel member, and wherein the second discharge part has a cross-section comprising a long slit shape parallel to a circumferential direction of the second channel member.

16. The laundry treatment apparatus according to claim 14, wherein the supply unit comprises:

a first supply pipe for communicating of the first introduction part with the water supply source;

a first valve for opening and closing the first supply pipe;

a second supply pipe for communicating of the second introduction part with the water supply source; and a second valve for opening and closing the second supply pipe.

17. The laundry treatment apparatus according to claim 16, further comprising:

a sensing unit for detecting a position of the laundry causing an unbalance of the drum; and a control unit for controlling the first and second valves to supply liquid to at least one of the first and second channel members during a period of time from a point where the drum is rotated by a predetermined standby angle after the laundry reaches a position of the supply unit to a point where the drum is rotated by a predetermined supply angle.

18. The laundry treatment apparatus according to claim 17, wherein the at least three balancers are spaced apart from one another along a circumferential surface of the drum by an angular interval of 120°, and wherein the predetermined standby angle is set to 60° and the predetermined supply angle is set to 120°.

* * * * *